United States Patent [19]

Sfarti et al.

[11] Patent Number: 4,622,546

[45] Date of Patent: Nov. 11, 1986

[54] APPARATUS AND METHOD FOR DISPLAYING CHARACTERS IN A BIT MAPPED GRAPHICS SYSTEM

[75] Inventors: Adrian Sfarti, Sunnyvale; Steven Dines, San Jose, both of Calif.

[73] Assignee: Advanced Micro Devices, Inc., Sunnyvale, Calif.

[21] Appl. No.: 564,970

[22] Filed: Dec. 23, 1983

[51] Int. Cl.[4] ..... G09G 1/16

[52] U.S. Cl. ..... 340/748; 340/747; 340/750; 340/799

[58] Field of Search ..... 340/748, 750, 798, 799, 340/723, 735, 747

[56] References Cited

U.S. PATENT DOCUMENTS

| | | | |
|---|---|---|---|
| 4,115,765 | 9/1978 | Hartke | 340/750 |
| 4,398,190 | 8/1983 | Long et al. | 340/747 |
| 4,468,662 | 8/1984 | Tanaka | 340/799 |
| 4,498,081 | 2/1985 | Fukushima et al. | 340/799 |

*Primary Examiner*—Gerald L. Brigance

*Attorney, Agent, or Firm*—Patrick T. King; Gary T. Aka; J. Vincent Tortolano

[57] ABSTRACT

An apparatus and a method for character and graphics pattern generation in a bit mapped graphics display system is disclosed that includes a pixel data manager 14 for supplying character bit maps and graphics patterns to a visible display memory 22. A character information memory 24 is utilized for the storage of character descriptive information which includes an address table 26, macro-instructions 28, 30, and 32, and character bit maps 34, 36, and 38. Each character in a set of characters has an associated macro-instruction and character bit map. The address table contains memory addresses that point to the macro-instructions. Each macro-instruction contains executable instructions that establish the size and location of a corresponding character bit map. To supply a character to the visible display memory, the pixel data manager fetches and executes a corresponding macro-instruction. Overhead burden on the central processing unit is minimized.

26 Claims, 5 Drawing Figures

APPARATUS AND METHOD FOR DISPLAYING CHARACTERS IN A BIT MAPPED GRAPHICS SYSTEM

BACKGROUND OF THE INVENTION

1. Field of the Invention

This invention relates generally to bit mapped graphics display systems used in computers, and relates more particularly to an apparatus and a method for reducing the overhead burden on a central processing unit during the generation of character output data.

2. Description of the Prior Art

Many prior art computers have the capability of generating both character and graphical output data. Some computers utilize a specialized circuit, known as a bit mapped graphics display system, to generate character and graphical output data. The bit mapped graphics display system generates output data in response to programmed instructions supplied by a central processing unit. A typical bit mapped graphics display system consists of a display memory for temporarily storing output data, a display memory driver circuit coupled to the central processing unit for generating and supplying output data to the display memory, a display device such as a cathode ray tube for displaying the output data in a perceptible form and a display driver for periodically transferring the output data from the display memory to the display device.

The term "bit mapped" refers to the method of storing the output data in the display memory. The display memory is visualized as a two dimensional array of pixels, where each pixel corresponds to an individual picture element in the display device. Each pixel in the display memory contains one bit of information: a value of either 0 or 1. The pixels as a whole form a two dimensional map that represents the display device. The bits of information in the map comprises the output data. Thus, the term "bit mapped" in a bit mapped graphics display system refers to the use of a bit map of pixels for the temporary storage of output data.

As mentioned above, each picture element of the display device is represented in the display memory by a corresponding pixel. When the output data stored in the display memory is transferred to the display device by the display driver, a perceptible image of the output data is formed by highlighting certain picture elements. Picture elements corresponding to those pixels having values equal to 1 are highlighted, while the remaining picture elements, corresponding to those pixels having values equal to 0, are left blank. The method of highlighting picture elements depends on the type of display device used. If the display device is a cathode ray tube, for example, a picture element is highlighted by beaming electrons to phosphors that comprise the picture element, causing the phosphors to glow.

Prior art computers with bit mapped graphics display systems are capable of generating and displaying both character and graphical output data. The generation and display of these two types of output data require two distinctly different modes of operation. Graphics patterns are generated by the display memory driver circuit by executing graphics instructions supplied by the central processing unit. Character output data is generated by transferring character bit maps from a character memory to the display memory.

Typical graphics instructions contain information as to the type and size of the pattern to be generated and the location in the display memory at which the pattern is to be placed. A processor within the display memory driver circuit executes the graphics instructions according to a stored program. Execution of the graphics instructions identifies which pixels correspond to the desired graphics pattern. Changing the values of the identified pixels completes the task of generating the graphics pattern. For example, a graphics instruction might direct that a straight line be drawn between two selected pixels. In executing the instruction, the display memory driver circuit identifies all the pixels that are located on a straight line between the two selected pixels, and changes the value of each to a 1.

The generation of character output data by prior bit mapped graphics display systems consists of a data transfer process, rather than a computational process as with graphical output data. The size and shape of each character are predetermined and stored in a character memory in the form of character bit maps. Each character bit map is a two dimensional group of pixels that represents a character. A complete character set typically consists of character bit maps for a range of alphabetic, numerical, punctuation, and other symbols. In general, character output data is accomplished by retrieving character bit maps from the character memory and by supplying those character bit maps to the display memory.

Several methods of transferring character bit maps from the character memory to the display memory, commonly called a block copy operation, are utilized by prior art bit mapped graphics display systems. One method uses the central processing unit of the computer for retrieval of the character bit maps from the character memory. To transfer a character to the display memory, the central processing unit first retrieves the character bit map from the character memory, and then transfers it to the display memory driver circuit. The display memory driver circuit, in turn, transfers the character bit map to the display memory. This method imposes a substantial overhead burden upon the central processing unit due to the time required to retrieve and transfer the character bit maps. Such an overhead burden is undesirable because it prevents the central processing unit from executing other instructions, thereby slowing the performance of the computer.

Another method of generating character output data reduces the overhead burden upon the central processing unit by utilizing the display memory driver circuit, rather than the central processing unit, to retrieve the character bit maps from the character memory. In order to permit direct access to the character bit maps by the display memory driver circuit, the display memory is expanded in size and partitioned into a visible portion and a nonvisible portion. The visible portion of the display memory is used for the temporary storage of the bit map representation of the output data, just as the display memory described above is used. The nonvisible portion of the display memory is used as the character memory for the storage of the character bit maps. In operation, the central processing unit supplies a character output instruction plus a character memory address to the display memory driver circuit. The display memory driver circuit executes the instruction by retrieving a character bit from the nonvisible display memory at the character memory address. The character bit map is then transferred to the visible display memory to complete the character output task.

Such a method reduces the overhead burden on the central processing unit, as compared to the previously described method. Overhead burden is reduced because the central processing unit has to supply only a character output instruction plus a character memory location to the display memory driver circuit, rather than an entire character bit map, for each character to be displayed. Although the overhead burden is reduced, it is not minimized. Once the central processing unit determines that a character is to be displayed, it has to perform several processing steps to locate, retrieve and supply the necessary instruction and character memory location data to the display memory driver circuit.

Some computers with bit mapped graphics display systems use character bit maps of variable size. Unfortunately, the ability to use variable size character bit maps doubles the overhead burden. To accommodate variable size character bit maps, the central processing units need to supply a character size instruction and associated data to specify the character size, in addition to the character output instruction and character memory location. As a result, the performance of such computers suffers greatly due to the overhead burden on the central processing unit during the generation of character output data.

What is needed, then, is a way of reducing the overhead burden on a central processing unit during the generation of character output data. What is specifically needed is a display memory driver circuit that operates with a minimal amount of supervision by the central processing unit, and that accommodates variable size characters.

SUMMARY OF THE INVENTION

In accordance with the illustrated preferred embodiment, the present invention provides an apparatus and a method for the generation of character and graphical output data in a bit mapped graphics display system. The apparatus according to the present invention includes a pixel data manager that provides processing means to supply character and graphical output data to a visible portion of a bit mapped display memory. The bit mapped display memory is divided into two portions: a visible display memory that is utilized to temporarily store output data, and a nonvisible display memory that contains a character information memory. The character information memory provides memory means for the storage of character descriptive information, including character bit maps and macro-instructions. The pixel data manager is operable for transferring character bit maps from the nonvisible display memory to the visible display memory by executing selected macro-instructions, and is also operable for executing graphics to supply graphics patterns to the visible display memory.

The character information memory includes an address table and pairs of macro-instructions and character bit maps that contain the character descriptive information for all characters of a character set. Stored in the address table are macro-instruction addresses, which are memory addresses that point to the macro-instructions. Each character of the character set has a corresponding macro-instruction and character bit map pair. Each macro-instruction includes an instruction and associated data that establish the size of the character, and another instruction and associated data that establish a character address. The character address is a memory address that points to the corresponding character bit map. Each character bit map is a two dimensional representation of a character. The characters of the character set include alphabetic, numerical, and punctuation symbols, and may also include additional symbols.

The pixel data manager responds to instructions issued by a central processing unit by supplying character bit maps and graphics patterns to the visible display memory. The pixel data manager operates in two modes: graphics mode for the execution of graphics instructions to generate graphics patterns, and macro mode for the transfer of character bit maps from the character information memory to the visible display memory. When in macro mode, the pixel data manager receives character codes from the central processing unit to indicate which character bit maps to transfer to the visible display memory.

The method of supplying character descriptive information, according to the present invention, involves the operation of the apparatus summarized above. Initially, the character descriptive information is transferred into the character information memory by the central processing unit. As described above, the character descriptive information includes character bit maps and macro-instructions for each character of the character set, and also includes an address table of macro-instruction addresses.

The method of supplying character descriptive information is performed when the pixel data manager is in macro mode. The method is initiated by the receipt of a character code from the central processing unit. Upon the receipt of the character code, the pixel data manager calculates a macro index that points to an address in the address table. Stored in the address table at that address is a macro-instruction address that points to a macro-instruction. This macro-instruction corresponds to the character represented by the character code. The pixel data manager fetches the macro-instruction address from the address table, and then fetches the macro-instruction from the character information memory, beginning at the character address, to the visible display memory. Accordingly, character bit maps are supplied to the visible display memory by a method that minimizes the overhead burden on the central processing unit.

DETAILED DESCRIPTION OF THE PREFERRED EMBODIMENT

Figure 1:
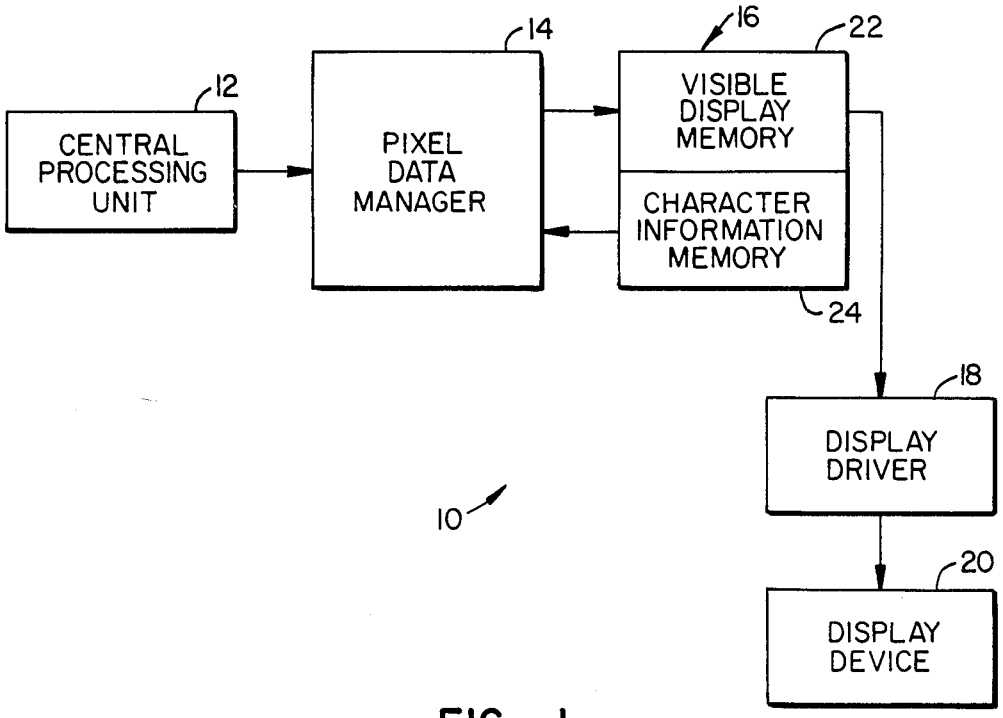
FIG. 1 is a block diagram of a bit mapped graphics display system.

The preferred embodiment of the present invention is an apparatus for the generation of character and graphical output data in a bit mapped graphics display system. A bit mapped graphics display system 10, as illustrated in FIG. 1, includes a central processing unit 12, a pixel data manager 14, a display memory 16, a display driver 18, and a display device 20. Display memory 16 is divided into a visible portion 22 that contains a bit map of the characters and graphics patters to be displayed, and a nonvisible portion 24 that contains a character information memory. Character bit maps and macro-instructions for the characters of a character set are stored in the character information memory.

The bit mapped graphics display system 10 displays characters and graphics patterns by executing instructions that originate in the central processing unit. The pixel data manager 14 receives and executes instructions to generate the characters and graphics patterns, and stores the resulting information in the visible display memory 22. The visible display memory is a two dimensional bit map of pixels containing the characters and graphics patterns to be displayed. The characters and patterns to be displayed appear as groups of pixels having value of 1 against a background of pixels having values of 0. Periodically, the display driver 18 scans the contents of the visible display memory, converts the data therein to a display signal, and issues the display signal to the display device 20. The display drive then forms a perceptible image in response to the display signal. The perceptible image is a representation of the information stored in the visible display memory.

The pixel data manager 14 supplies both graphics patterns and character representations to the visible display memory 16. The pixel data manager is a graphics and character processor that operates in either of two modes: a graphics mode to generate graphics patterns and supply them to the visible display memory, and a macro mode to copy character descriptive information from the character information memory to the visible display memory.

In graphics mode, the pixel data manager operates as do prior art display memory driver circuits. It receives graphic instructions and data from the central processing unit, and generates graphics patterns by executing the graphics instructions. To draw a straight line between two coordinate points, for example, the central processing unit issues a "DRAW VECTOR" instruction and data describing the two coordinate points. In executing the "DRAW VECTOR" instruction, the pixel data manager determines which pixels in the visible display memory correspond to the two coordinate points, determines which pixels in the visible display memory lie upon a straight line therebetween, and changes the stored values of those pixels to 1's. In this manner, the pixel data manager supplies graphics patterns to the visible display memory.

In macro mode, however, the pixel data manager operates quite differently from prior art display memory driver circuits. In macro mode, the pixel data manager advantageously operates to supply characters in the form of bit maps to the visible display memory with a minimum of overhead burden on the central processing unit. To supply a character bit map to the visible display memory, the pixel data manager retrieves and executes two macro-instructions from the character information memory. Execution of the first macro-instruction establishes a two-dimensional size of the character bit map. Execution of the second macro-instruction transfers a copy of the character bit map from the character information memory to the visible display memory.

A total of twelve bytes of information is required to transfer a character to the visible display memory: two bytes for each of the two macro-instructions, four bytes for character size data, and four bytes for character address data. Prior art bit mapped graphics display systems receive the two macro-instructions and all of the data associated therewith from the central processing unit. The present invention, however, receives only a single byte of information from the central processing unit. The pixel data manager of the present invention supplies characters to the visible display memory upon the receipt of a one byte character code from the central processing unit. The one byte character code is used as a pointer into the character information memory, where macro-instructions and their associated data are stored. To reduce the overhead burden on the central processing unit, the pixel data manager executes macro-instructions that are stored in the character information memory, rather than by executing instructions that come from the central processing unit.

Figure 2:
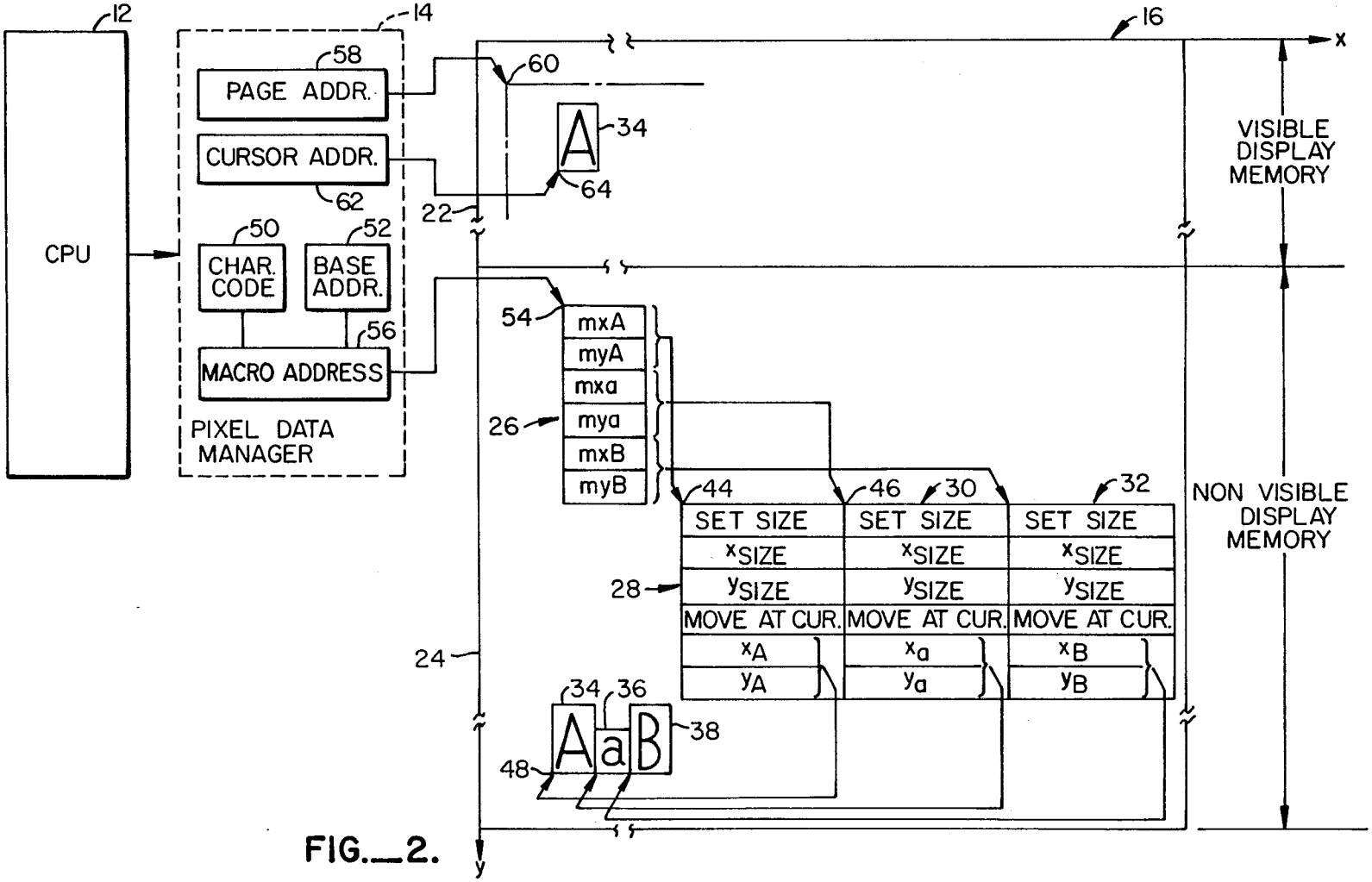
FIG. 2 is a block diagram of an apparatus for the generation of character and graphical output data in a bit mapped graphics display system, according to the present invention.

FIG. 2 illustrates the structure of the pixel data manager 14 and character information memory 24, according to the present invention. Character descriptive information stored in the character information memory is of three types: an address table 26, macro-instructions 28, 30, and 32, and character bit maps 34, 36, and 38. Each character of the character set has a corresponding macro-instruction and character bit map pair. For example, macro-instruction 28 and bit map 34 form a pair that corresponds to the character "A." In the preferred embodiment of the present invention, the character information memory is a random access memory that is initialized by the central processing unit with data that contains the address table, the macro-instructions, and the character bit maps. Initialization of the character information memory is accomplished at the commencement of system operation. Alternatively, the character information memory could be a programmable read only memory (PROM), with the character descriptive information stored therein. All addresses in the display memory are represented geometrically in FIG. 2 by an "X" and a "Y" address.

Figure 3:
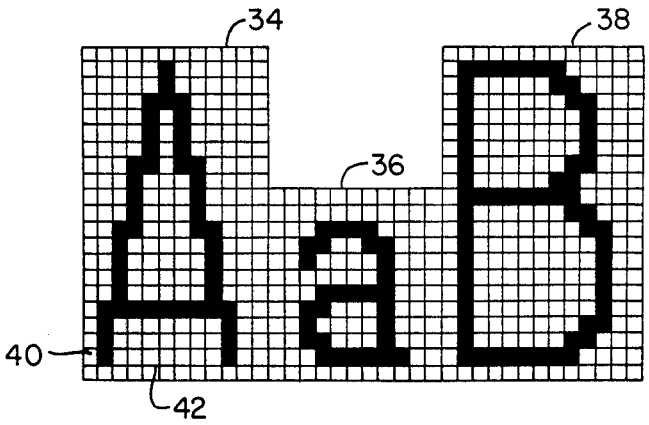
FIG. 3 is a graphical representation of three exemplary character bit maps.

Character bit maps 34, 36, and 38 are shown in greater detail in FIG. 3. Each character is represented two-dimensionally by a rectangular field of pixels. In FIG. 3, the characters are represented by shaded pixels 40 against a background of unshaded pixels 42. As stored in the character information memory, the shaded pixels of the character bit map have a value of 1 to represent the character and the unshaded pixels have a value of 0 to represent the background. As displayed by the display device, the shaded pixels would appear as highlighted picture elements, and the unshaded pixels would be blank.

Address table 26 contains macro-instruction addresses that are memory addresses of the macro-instructions. For example, macro-instruction 28, which corresponds to the character "A," is located at a memory address 44 as specified by "MXA" and "MYA," and macro-instruction 30, which corresponds to the character "a," is located at a memory address 46 as specified by "MXa" and "MYa." The function of the address table is to point to the location of each of the macro-instructions. The address table permits the placement of the macro-instructions at any location within the nonvisible display memory without affecting the pixel data manager.

Each macro-instruction contains two executable instructions and associated data. The first instruction stored in a macro-instruction is "SET SIZE," and its associated data is "X-size" and "Y-size." Execution of this instruction establishes the size of its corresponding character bit map. For example, macro-instruction 28, which corresponds to character bit map 34, has a value of twelve for "X-size" and a value of twenty-one for "Y-size"; while macro-instruction 30, which corresponds to character bit map 36, has a value of eleven for "X-size" and a value of twelve for "Y-size." Since each macro-instruction can independently establish a character size, each character of the character set can have an independent size. This feature is useful in reducing the memory required to store the character bit maps, and is also useful in permitting the use of proportionally spaced characters.

The second instruction stored in a macro-instruction is "MOVE AT CURSOR," and its associated data is a character address. Each character address is a memory address of the beginning of the corresponding character bit map. For example, the character address of macro-instruction 28 is given by a character X address, "XA," and a character Y address, "YA." The character address points to the beginning 48 of character bit map 34. The "MOVE AT CURSOR" instruction directs the pixel data manager to transfer a copy of the character bit map located at the character address from the character information memory to the visible display memory.

The pixel data manager 14 contains several registers for the storage of various parameters. A character code register 50 contains the value of the character code supplied by the central processing unit. A base address register 52 contains a base address having a value that corresponds to the first address 54 of the address table 26. A macro address register 56 contains an arithmetic combination of the values in registers 50 and 52. This arithmetic combination is called a macro index, and is equal to the address of a macro-instruction address in the address table. The macro-instruction address points to the macro-instruction that corresponds to the character code store in register 50.

The address table is organized in the same order as is the set of character codes. If, for example, the character codes of the characters "A," "a," and "B" are in numerical order, then the address table entries for macro-instruction addresses "MXA," "MYA," "MXa," §'MYa," and "MXB," "MYB," would also be in numerical order. This allows the macro index of any character in the character set to be calculated by arithmetically combining the character code and the base address. In the example shown in FIG. 2, the macro index for the character "a" would be computed by adding two in the Y direction and zero in the X direction to the base address.

Several different character sets, each having a different font, can easily be accommodated. Each character set must have a corresponding address table and pairs of macro-instructions and character bit maps stored in the character information memory. A character set is specified by storing its corresponding base address into the base address register 52. All macro indices that are calculated using one particular base address will point to its corresponding address table, resulting in the use of the character bit maps of the selected character set. Therefore, different character sets can be selected by merely changing the value of the base address register.

Two registers in the pixel data manager 14 are used to specify the location in the visible display memory 22 where a character bit map is to be placed. The visible display memory contains several pages of display information. This arrangement permits the display of one page, while allowing the pixel data manager to update other pages. It also permits rapid scrolling through the several pages without increasing the overhead burden on the central processing unit. In order to select a page, a page address register 58 is used. It contains a value corresponding to a memory address 60 of the beginning of a page.

Characters are placed within a page at a location specified by a cursor. A cursor address register 62 contains the address of the cursor, which corresponds to the memory location at which the next character is to be placed. In FIG. 2, for example, character bit map 34 for the character "A" has been placed at cursor position 64. The "MOVE AT CURSOR" instruction directs the pixel data manager to transfer a copy of a character bit map from the character information memory to the visible display memory at the cursor position. After a character has been placed into the visible display memory, the cursor address register is incremented by "X-size" to reposition the cursor for the placement of the next character.

Figure 4:
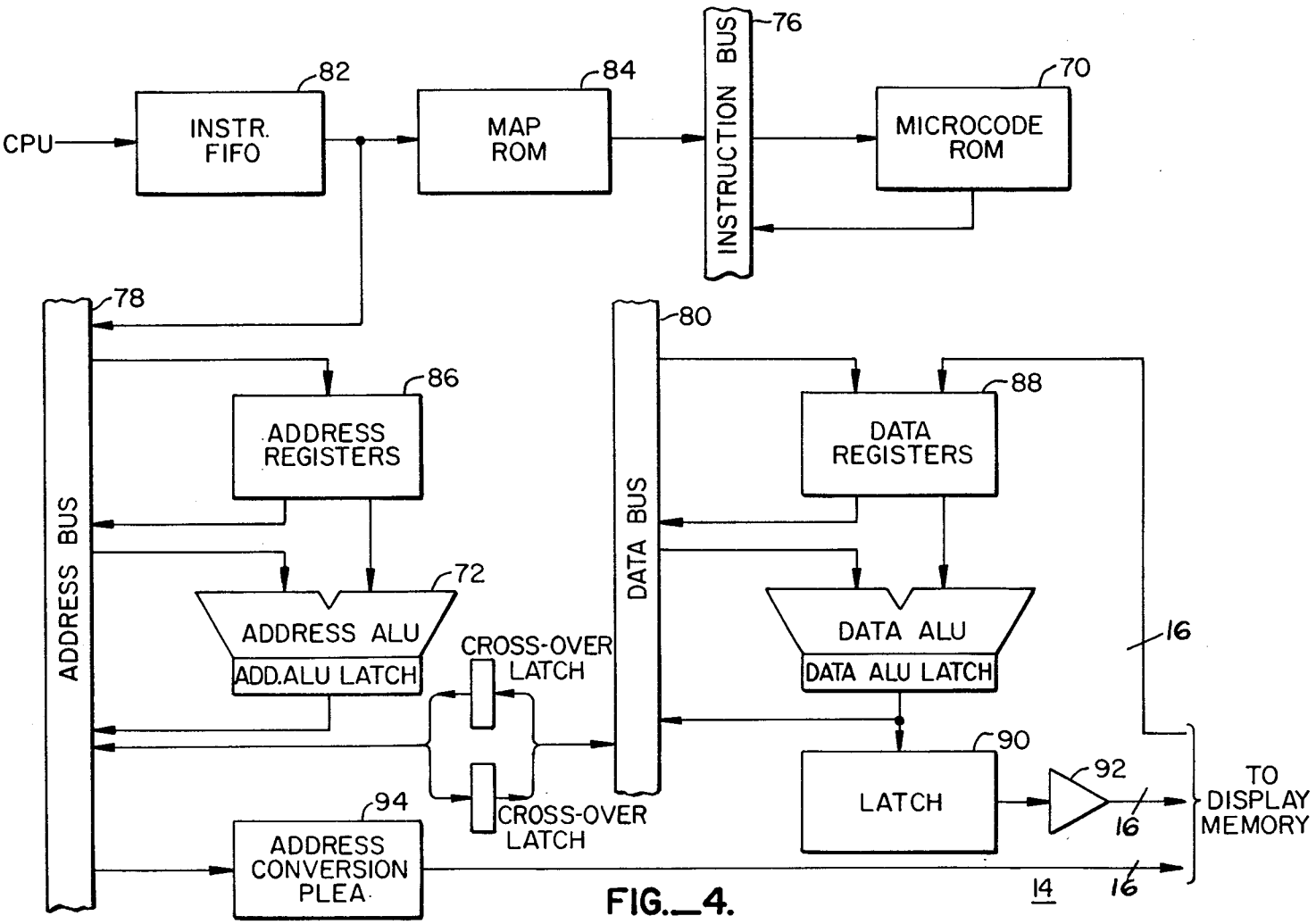
FIG. 4 is a schematic diagram of a pixel data manager that is utilized in the apparatus of FIG. 2.

Details of the graphics and character processor that comprises the pixel data manager 14 are shown in FIG. 4. Instructions are executed according to a micro-code program stored in a micro-code ROM (read only memory) 70. Operationally, an Address ALU (arithmetic logic unit) 72 generates display memory addresses, and a Data ALU 74 intensifies the appropriate pixels of the visible display memory. The graphics and character processor is constructed according to commonly known principles, and includes an instruction bus 76, an address bus 78, and a data bus 80 for interconnection of its component parts. The graphics and character processor includes an instruction FIFO memory (first in—first out) 82 that receives and temporarily stores instructions from the central processing unit, and a map ROM 84 that decodes the instructions. The map ROM is coupled to the micro-code ROM through the instruction bus 76. The graphics and character processor also includes address registers 86 coupled to the address bus and the Address ALU, and data registers 88 coupled to the data bus and the Data ALU. The output terminal of of the Data ALU is coupled to the data and address buses, and to a latch 90. The output terminal of latch 90 passes through a buffer 92 to an external data bus (not shown) for connection to the display memory. Data from the display memory is received from the external data bus by the data registers 88. An address conversion PLA (programmed logic array) 94 is coupled between the address bus and an external address bus (not shown) for connection to the display memory.

The address conversion PLA is provided to convert geometrical memory addresses used by the pixel data manager into absolute memory addresses for accessing the display memory. Both the visible and nonvisible portions of the display memory are connected to the external data and external address buses. This permits both the visible and the nonvisible portions of the display memory to be addressed through the PLA. The PLA permits the display memory addresses to be represented in geometrical form in the pixel data manager to facilitate programming. The logic pattern that is programmed into the PLA is determined by the capacities and arrangement of the physical memory devices that comprise the display memory. Changes in the physical memory devices can be accommodated without reprogramming the micro-code ROM by simply substituting a different PLA.

Figure 5:
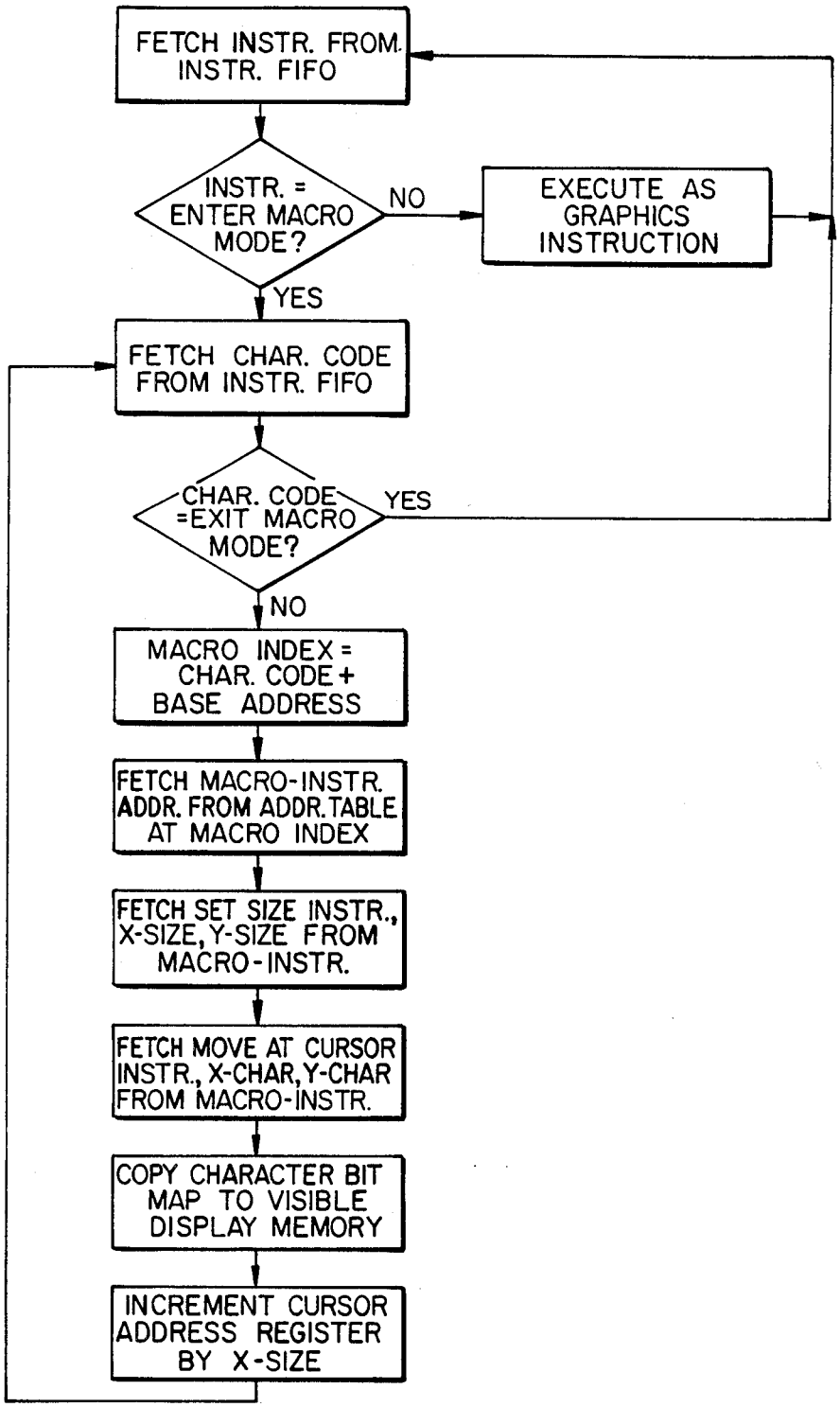
FIG. 5 is a flow chart of the operation of the pixel data manager.

The operation of the graphics and character processor is illustrated by the flow chart of FIG. 5. The first step is to fetch an instruction from the instruction FIFO 82. This instruction is decoded by the map ROM 84. If the instruction is a graphics instruction, the map ROM points to an address in the micro-code ROM 70 to begin the execution of an appropriate portion of the micro-code. The processor proceeds to execute the graphics instruction according to well known procedures. If, however, the instruction is "ENTER MACRO MODE," then the map ROM points to an address in the micro-code ROM that executes a macro mode program. When the processor is in macro mode, instructions supplied by the central processing unit are interpreted as character codes. The next step in macro mode, then, is to fetch a character code from the instruction FIFO and store it in an address register 86. If the character code is equal to any value other than that of of "EXIT MACRO MODE," then the processor proceeds to transfer a character bit map from the character information memory to the visible display memory. If the character code equals "EXIT MACRO MODE," then the processor exits the macro mode program and executes the next instruction as a graphics instruction.

The next step in the macro mode program is to calculate a macro index. This is accomplished in the illustrated embodiment by the Address ALU 72 by adding twice the value of the character code to the Y component of a base address stored in another address register. The resultant macro index is converted by the address conversion PLA 94 into an absolute address and is supplied to the external address bus.

Next, the processor fetches a macro-instruction address from the address table at the memory address of the macro index. The data stored in the address table is loaded into a data register 88 and is then transferred to the Address SLU. The macro-instruction address points to a memory address of a macro-instruction that, when executed, will transfer the appropriate character bit map into the visible display memory.

Next, the processor fetches the first half of the macro-instruction from the character information memory at a memory address equal to the macro-instruction address. The first half of the macro-instruction includes a "SET SIZE" instruction and "X-size" and "Y-size" data. The "SET SIZE" instruction is read into a data register and is then transferred to the micro-code ROM for execution. The "X-size" and "Y-size" data is read into data registers and is then transferred to address registers. This data will be utilized in defining how many pixels will be transferred to the visible display memory. The data bus is connected to the address bus via 16 lines and a bidirectional cross-over latch.

The processor then fetches the second half of the macro-instruction from the character information memory. The second half of the macro-instruction includes a "MOVE AT CURSOR" instruction and "X-char" and "Y-char" data. The instruction is transferred to the micro-code ROM for execution, while the data is transferred to the address registers. The "X-char" and "Y-char" data indicate a memory address for the beginning of the character bit map.

Having defined the character bit map size and location, the processor is now ready to start a block copy operation, i.e., the transfer of a copy of the character bit map to the visible display memory at the position of the cursor. For one preferred embodiment of the present invention, the transfer of the character bit map is accomplished one slice of 16 bits at a time from the character information memory 24. The processor fetches the 16 bits at $X_A$ to $X_A+15$, $Y_A$ and stores them in one of the data registers. The "X-size" data determines whether more bits are required to complete the character bit map in the X direction or whether more than a sufficient number of bits in X direction have been fetched. In the former case, another 16 bits ($X_A+16$ to $X_A+31$) are fetched. In the latter case, no more bits in the X direction are fetched. The next slice of 16 bits is at location $X_A$ to $X_A+15$, $Y_A+1$. The "Y-size" data determines the number of fetched slices in the Y direction for the character bit map.

The Address ALU generates the address in the visible display memory to which each slice is to be sent. The Data ALU then sends the slice to the display memory through the external data bus. This process continues slice by slice until all of the character bit map has been copied into the visible display memory. It should be noted that the block copy operation described above includes that the standard operations of bit masking and logic combination are also performed to ensure that only the character bit map specified by the "X-size" and "Y-size" data is transferred into the display memory without affecting neighboring memory locations in the display memory.

The last step is to reposition the cursor. To do so, the Address ALU adds the value of the "X-size" to the current cursor position to calculate an updated cursor position. The updated cursor position is stored in an address register for use in placing the next character in a series of characters.

Another character code is then fetched from the instruction FIFO and is tested to determine whether it is an "EXIT MACRO MODE." If it is not, another character bit map is placed into the visible memory. If it is, the processor exits macro mode and reenters graphics mode.

In an alternative embodiment of the present invention, executable instructions in addition to "SET SIZE" and "MOVE AT CURSOR" are stored in the nonvisible display memory. Such instructions could be graphics instructions that are executed using common or repetitious data. Providing graphics instructions to the pixel data manager from the nonvisible display memory rather than from the central processing unit would further reduce central processing unit overhead.

In still another alternative embodiment of the present invention, the graphics and character processor fetches both a portion of a character bit map from the character information memory and a portion of the visible display memory. By combining the two and then writing the resultant combination into the visible display memory, characters can be superimposed over existing graphics patterns.

From the above description, it will be apparent that the invention disclosed herein provides a novel and advantageous apparatus and method for displaying characters and graphics patterns in a bit mapped graphics display system. As will be understood by those familiar with the art, the invention may be embodied in other specific forms without departing from the spirit or essential characteristics thereof. For example, the Data ALU portion of the pixel data manager could be arranged with parallel processing circuits to define parallel pages within the visible display memory to permit the use of multicolor picture elements. Accordingly, the disclosure of the present invention is intended to be illustrative, but not limiting, of the scope of the invention, which is set forth in the following claims.

What is claimed is:

1. In an apparatus having a character information memory and a visible display memory, wherein said character information memory includes descriptive information for a character set, said descriptive information includes an address table, pairs of macro-instructions and character bit maps, each of said pairs of macro-instructions corresponds to one character of said character set, at least one of said macro-instructions in each of said pairs includes a character address that points to the memory location of its corresponding character bit map, and said address table includes macro-instruction addresses that point to the memory locations of said macro-instructions, said apparatus comprising:

processing means coupled to said character information memory and to said visible display memory for fetching a designated portion of the contents of said display memory and a character code that designates a character in said character information memory which is to be combined with said designated portion of the contents of said display memory, said processing means including means for fetching said pair of macro-instructions which correspond to said character code from said character information memory, and means including an arithmetic logic unit means for executing said pair of macro-instructions to selectively combine logically or arithmetically said character from said character information memory with said designated portion of said contents of said visible display memory and copy the result therefrom back into said visible display memory.

2. An apparatus as recited in claim 1 wherein said processing means combines a base address with said character code to calculate a memory address of a corresponding macro-instruction address for use in fetching a macro-instruction, and wherein said base address corresponds to the first memory address of said address table.

3. An apparatus as recited in claim 2 wherein said character information memory includes descriptive information for additional character sets, said descriptive information for each of said additional character sets including an address table with a base address corresponding thereto, and pairs of macro-instructions and character bit maps corresponding to the characters of said character set, and wherein a character set is selected for use by utilizing its base address for fetching macro-instructions.

4. An apparatus as recited in claim 1 wherein each macro-instruction includes executable instructions, and wherein said processing means is operable for supplying character bit maps to said visible display memory by executing said instructions.

5. An apparatus as recited in claim 4 wherein said macro-instruction includes an executable instruction for setting a character size, and wherein said macro-instruction further includes an X-size value for setting character size in one dimension and a Y-size value for setting character size in another dimension.

6. An apparatus as recited in claim 5 further comprising means for transferring a series of character bit maps to said visible display memory, said means is operable for positioning said character bit maps in said visible display memory at positions that are spaced apart by amounts determined by the X-size values of said character bit maps.

7. An apparatus for supplying character bit maps and graphics patterns to a visible display memory, said character information memory including an address table and pairs of macro-instructions and character bit maps, wherein each of said pairs corresponds to one character of a character set, wherein each of said macro-instructions includes a character address that points to the memory location of its corresponding bit map, and wherein said address table includes macro-instruction addresses that point to the memory locations of said macro-instructions, said apparatus comprising:

processing means coupled to said character information memory and said visible display memory for operating in a macro mode for supplying character bit maps to said visible display memory and for operating in a graphics mode for supplying graphics patterns to said visible display memory;

said processing means is operable in said macro mode for receiving a character code that designates an action to be executed, for fetching a macro-instruction corresponding to said character code from said character information memory, and means, including an arithmetic logic unit means, for executing said macro-instructions to selectively combine logically or arithmetically said character from said character information memory with said designated portion of said contents of said visible display memory and copy the result therefrom back into said visible display memory; and said processing means is operable in said graphics mode for receiving graphics instructions from said central processing unit, and for executing said graphics instructions to place graphics patterns into said visible display memory.

8. An apparatus for supplying character descriptive information to a visible portion of a bit mapped display memory, said apparatus comprising:

memory means for storing character descriptive information for a character set, said memory means including an address table and pairs of macro-instructions and character bit maps, wherein each of said pairs corresponds to one character of said character set, wherein each of said macro-instructions includes a character address that points to the memory location of its corresponding character bit map, and wherein said address table includes macro-instruction addresses that point to the memory locations of said macro-instructions; and processing means, coupled to said memory means, for receiving a character code that designates a character to be supplied, for fetching a macro-instruction corresponding to said character code from said memory means, and means, including an arithmetic logic unit means, for executing said macro-instructions to selectively combine logically or arithmetically said character from said character information memory with said designated portion of said contents of said visible display memory and copy the result therefrom back into said visible display memory.

9. An apparatus as recited in claim 8 wherein said memory means is a random access memory that is initialized with data representing said address table, said macro-instructions, and said character bit maps.

10. An apparatus as recited in claim 9 wherein said bit mapped display memory includes said memory means in a nonvisible portion thereof, and wherein said processing means is coupled to said bit mapped display memory through an external data bus and an external address bus.

11. An apparatus as recited in claim 8 wherein said processing means combines a base address with said character code to calculate a memory address of a corresponding macro-instruction address, and wherein said base address corresponds to the first memory address of said address table.

12. An apparatus as recited in claim 11 wherein said memory means includes additional character descriptive information for additional character sets, each of said additional character sets having an additional address table with an additional base address corresponding thereto, and additional pairs of macro-instructions and character bit maps, and wherein a character set is selected for use by utilizing its corresponding base address in calculating memory addresses for corresponding macro-instruction addresses.

13. An apparatus as recited in claim 8 wherein each macro-instruction includes executable instructions, and wherein said processing means is operable for supplying character bit maps to the visible portion of the bit mapped display memory by executing said instructions.

14. An apparatus as recited in claim 13 wherein each macro-instruction includes an executable instruction for setting a character size, and wherein said macro-instruction further includes an X-size value for setting character size in one dimension and a Y-size value for setting character size in another dimension.

15. An apparatus as recited in claim 14 wherein said apparatus is operable for supplying character descriptive information to the visible portion of the bit mapped display memory for a series of characters, said processing means is operable for combining the character bit map for each character with the display memory at addresses in the display memory that are spaced apart by amounts determined by the X-size values of said characters.

16. An apparatus as recited in claim 8 wherein said memory means further includes graphics instructions, and wherein said processing means is operable for supplying graphics patterns to the visible portion of the bit mapped display memory by executing said graphics instructions.

17. An apparatus for supplying character descriptive information and graphics patterns to a bit mapped display memory, said apparatus comprising:

memory means for storing character descriptive information for a character set, said memory means including an address table and pairs of macro-instructions and character bit maps, wherein each of said pairs corresponds to one character of said character set, wherein each of said macro-instructions includes a character address that points to the memory location of its corresponding character bit map, and wherein said address table includes macro-instruction addresses that point to the memory locations of said macro-instructions; and processing means, coupled to said memory means, for operating in a macro mode for supplying character descriptive information to said bit mapped display memory and for operating in a graphics mode for supplying graphics patterns to said bit mapped display memory;

said processing means is operable in said macro mode for receiving a character code that designates a character to be supplied, for fetching a macro-instruction corresponding to said character code from said memory means, and means, including an arithmetic logic unit means, for executing said macro-instructions to selectively combine logically or arithmetically said character from said character information memory with said designated portion of said contents of said visible display memory and copy the result therefrom back into said visible display memory;

said processing means is operable in said graphics mode for receiving graphics instructions from said central processing unit, and for executing said graphics instructions to place graphics patterns into said bit mapped display memory.

18. A method of supplying character descriptive information to a visible portion of a bit mapped display memory, said method comprising the steps of:

providing a character information memory that includes character descriptive information for all characters of a character set, said character information memory including an address table and pairs of macro-instructions and character bit maps, wherein each of said pairs corresponds to one character of said character set, wherein each of said macro-instructions includes a character address that points to the memory location of its corresponding character bit map, and wherein said addresss table includes macro-instruction addresses that point to the memory locations of said macro-instructions;

receiving a character code that identifies a character to be displayed;

fetching a macro-instruction corresponding to said character code from said character information memory; and executing in an arithmetic logic unit said macro-instructions to selectively combine logically or arithmetically said character from said character information memory with said designated portion of said contents of said visible display memory and copy the result therefrom back into said visible display memory.

19. A method as recited in claim 18 wherein said step of providing a character information memory is accomplished by initializing a random access memory with data representing said address table and said pairs of macro-instructions and said character bit maps.

20. A method as recited in claim 18 further comprising steps of:

calculating a macro index corresponding to said character code, said macro index is a memory address in said address table that corresponds to said character to be displayed; and fetching a macro-instruction address from said address table at said macro index.

21. A method as recited in claim 20 wherein said step of calculating a macro index is accomplished by arithmetically combining a base address and said character code, wherein said base address corresponds to the first memory address of said address table.

22. A method as recited in claim 21 wherein said character information memory includes additional character descriptive information for additional character sets, each of said additional character sets having an additional address table with an additional base address corresponding thereto, and additional pairs of macro-instructions and character bit maps, and wherein said method further comprises the step of selecting a character set by selecting a base address, with said step of selecting a character set occurring before said step of calculating a macro index.

23. A method as recited in claim 18 wherein said step of executing said macro-instruction is accomplished by executing at least two instructions contained within said macro-instruction using data stored within said macro-instruction, and wherein said character bit map is combined with said display memory at the position of a cursor.

24. A method as recited in claim 23 wherein the execution of one of said instructions defines the two-dimensional size of the character bit map according to an X-size value and a Y-size value stored within said macro-instruction.

25. A method as recited in claim 24 wherein said method is additionally capable of supplying character descriptive information to said display memory for a series of characters, and wherein said method further comprises the steps of:

repositioning said cursor after executing said macro-instruction by adding said X-size value to the current position of the cursor; and repeating said steps of receiving a character code, calculating a macro index, fetching a macro-instruction address, fetching a macro-instruction, executing said macro-instruction, and repositioning said cursor until character descriptive information for said series of characters has been supplied to said display memory.

26. An apparatus for displaying characters and graphics patterns on a display, said apparatus comprising:

a central processing unit for supplying character codes and graphics instructions;

a pixel data manager circuit, coupled to said central processing unit to receive said character codes and graphics instructions, said pixel data manager circuit is operable for defining a bit map representation of characters and graphics patterns;

a character information memory, coupled to said pixel data manager circuit, for storing and supplying character descriptive information, said character information memory including an address table, macro-instructions, and character bit maps;

a visible display memory, coupled to said pixel data manager circuit, for storing a bit map representation of characters and graphics patterns to be displayed;

a display driver circuit, coupled to said visible display memory, for scanning said visible display memory and for generating a display signal in response thereto; and a display device, coupled to said display driver circuit, for receiving said display signal and for displaying an image in response thereto;

said pixel data manager circuit is operable for supplying bit map representatives of graphics patterns to said visible display memory by executing said graphics instructions, said pixel data manager circuit is also operable for supplying bit map representations of characters to said visible display memory by fetching a corresponding macro-instruction from said character information memory, and means, including an arithmetic logic unit means, for executing said macro-instructions to selectively combine logically or arithmetically said character from said character information memory with said designated portion of said contents of said visible display memory and copy the result therefrom back into said visible display memory.

* * * * *